US007234192B2

(12) United States Patent
Barbar

(10) Patent No.: US 7,234,192 B2
(45) Date of Patent: Jun. 26, 2007

(54) COMPACT DISPOSABLE FINGER-MOUNT TOOTHBRUSH

(76) Inventor: Munib Barbar, 270 N. Canon Dr. #1544, Beverly Hills, CA (US) 90210

( * ) Notice: Subject to any disclaimer, the term of this patent is extended or adjusted under 35 U.S.C. 154(b) by 375 days.

(21) Appl. No.: 11/062,660

(22) Filed: Feb. 23, 2005

(65) Prior Publication Data

US 2006/0185106 A1 Aug. 24, 2006

(51) Int. Cl.
*A46B 9/04* (2006.01)
*A46B 5/04* (2006.01)

(52) U.S. Cl. ..... 15/167.1; 15/227; 15/184; 206/362.2

(58) Field of Classification Search ..... 15/167.1, 15/184, 227; 206/362.2
See application file for complete search history.

(56) References Cited

U.S. PATENT DOCUMENTS

| | | | |
|---|---|---|---|
| 2,396,548 | A | 3/1946 | Allen |
| 4,134,172 | A | 1/1979 | Arce |
| 4,251,897 | A | 2/1981 | Alam |
| 5,181,531 | A | 1/1993 | Excoto et al. |
| 5,287,584 | A | 2/1994 | Skinner |
| 6,808,068 | B2 | 10/2004 | Abada |
| 7,014,463 | B2 * | 3/2006 | Savoia ..... 433/141 |
| 2004/0181891 | A1 | 9/2004 | Snarkar et al. |

FOREIGN PATENT DOCUMENTS

GB 2243072 A 10/1991

OTHER PUBLICATIONS

"Dental products for promotions," http://www.asisuplier.com/69490/Dental.htm. 6 pages, printed from the Internet Nov. 17, 2004.

* cited by examiner

*Primary Examiner*—Randall Chin
(74) *Attorney, Agent, or Firm*—Richard C. Litman

(57) ABSTRACT

A compact disposable toothbrush has a flat, elongate bristle-receiving body having bristles extending downward therefrom in the manner of a traditional toothbrush. A finger clip formed by elongate curved elastic portions extends upward along the length of the bristle receiving body. The elastic action of the curved portions secures mounting to varying sizes of finger. The finger clip has side openings in each and inner guide ridges to avoid lateral movement and rotation on the finger. A bristle cover snaps over bristle-receiving body for removal and replacement and seals against the body and the lower wall of the finger. The toothbrush and cover may be supplied as a kit with a single portion of toothpaste provided in the cover as snapped closed over the bristle portion of the toothbrush, the bristles extending into the toothpaste. The kit is supplied in a wrapper for sanitary distribution.

20 Claims, 5 Drawing Sheets

COMPACT DISPOSABLE FINGER-MOUNT TOOTHBRUSH

BACKGROUND OF THE INVENTION

1. Field of the Invention

The present invention relates to dental hygiene appliances. More particularly, the present invention relates to a compact, disposable finger-mount toothbrush and kit.

2. Description of the Related Art

There are many examples of compact toothbrushes such as travel toothbrushes which have removable handles which may be compactly stored in a kit or the like. The kit may also include a tube of toothpaste. Also known are finger-mount toothbrushes. These brushes are of two general types. One type has a brush on the end of a flexible finger cover or glove. Another type is placed on an index finger in the manner of a finger ring.

One problem with known designs, particularly those employing a flexible cover for the finger, is keeping the toothbrush bristles from rotating or pulling away from the finger during use. Many of the finger ring type also suffer from instability of placement relative to the finger and teeth during use. The finger ring type does not have a brush cover for single or multiple use and is either not provided in a kit including toothpaste, have a complicated, unreliable design for applying toothpaste to the bristles, or require a separate toothpaste tube either in the kit or separate therefrom.

It would be desirable to provide a compact, finger-mount toothbrush which may be used once and disposed of or repeatedly used, having a removable and replaceable cover for the bristles, the bristles having a single use portion of toothpaste provided directly on the bristles of the toothbrush. It would also be desirable that the compact toothbrush requires minimum manipulation to use. This would be particularly useful for photography and moving picture studios where a subject or actor may require a quick brushing. In such settings time is valuable and a compact toothbrush ready to use with minimum preparation effort is highly desirable. It would also be desirable that such a toothbrush be reusable, if desired, for the duration of a trip, etc., yet simple, compact, and inherently inexpensive to allow for disposable, one-time use.

None of the above inventions and patents, taken either singly or in combination, is seen to describe the instant invention as claimed. Thus, a compact disposable finger-mount toothbrush solving the aforementioned problems is desired.

SUMMARY OF THE INVENTION

The compact disposable toothbrush of the present invention has a flat, elongate bristle-receiving body having bristles extending outward therefrom in the manner of a traditional toothbrush. A finger clip in the form of an open band ring formed by elongate curved elastic portions extends upward along the length of the bristle receiving body to partially surround the index finger. The elastic action of the curved portions allows for secure mounting to varying sizes of finger.

The elongate finger clip has side openings in each side to allow side portions of the finger to press into the openings reducing lateral and rotating movement of the brush bristle portion relative to the finger. Inner guide ridges extend along the length of the inner wall of the finger clip, further reducing rotation of the clip relative to the finger.

A bristle portion cover is provided which fully receives the bristles and conforms to the shape of the bristle-receiving body having an upper lip portion which snaps closed over the body and seals against the body and the lower wall of the finger clip to protect the bristles from contamination during storage, but is easily snapped away for use. The toothbrush and cover may be supplied as a kit with a single portion of toothpaste provided in the cover as snapped closed over the bristle portion of the toothbrush, the bristles extending into the toothpaste, making it compact and extremely easy and quick to use. The kit may be packaged in a sealed wrapper for sanitary distribution and storage.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The present invention is a finger-mounted, disposable toothbrush provided in a kit having a toothbrush-conforming brush cover containing toothpaste.

Figure 1:
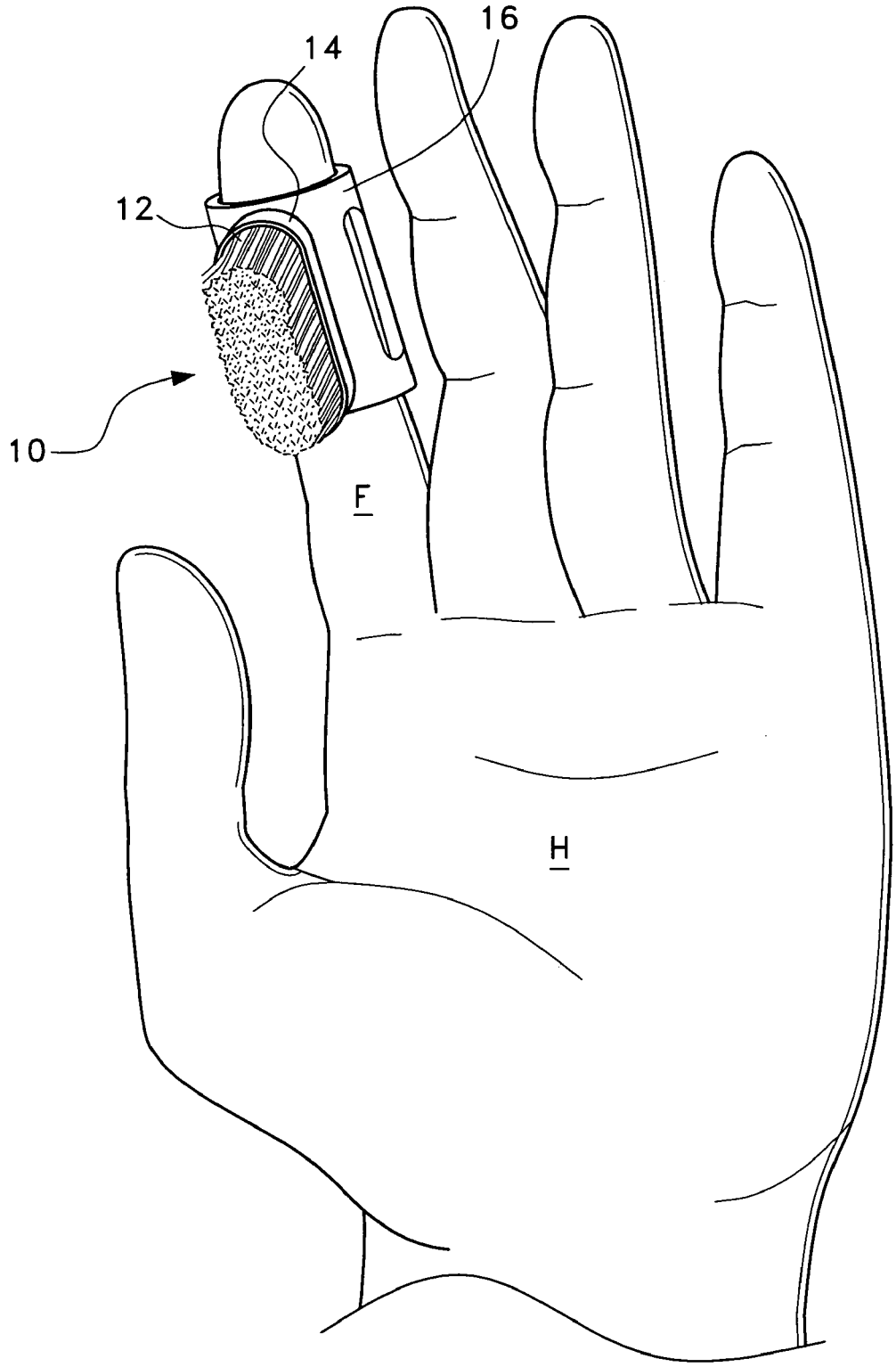
FIG. 1 is an environmental, perspective view of a compact disposable toothbrush according to the present invention.

Referring to FIG. 1, there is shown an environmental perspective view of the finger-mounted toothbrush of the present invention referred to herein by the reference No. 10. Toothbrush 10 has a bristle portion 12 mounted in a bristle receiver 14 which, in turn, is attached to finger clip 16 as shown being worn on index finger F of hand H. The bristles of bristle portion 12 are embedded at their upper ends in bristle receiver 14. Bristle receiver 14 may be attached to finger clip 16 or be of unitary construction with finger clip 16 as desired.

Figure 2:
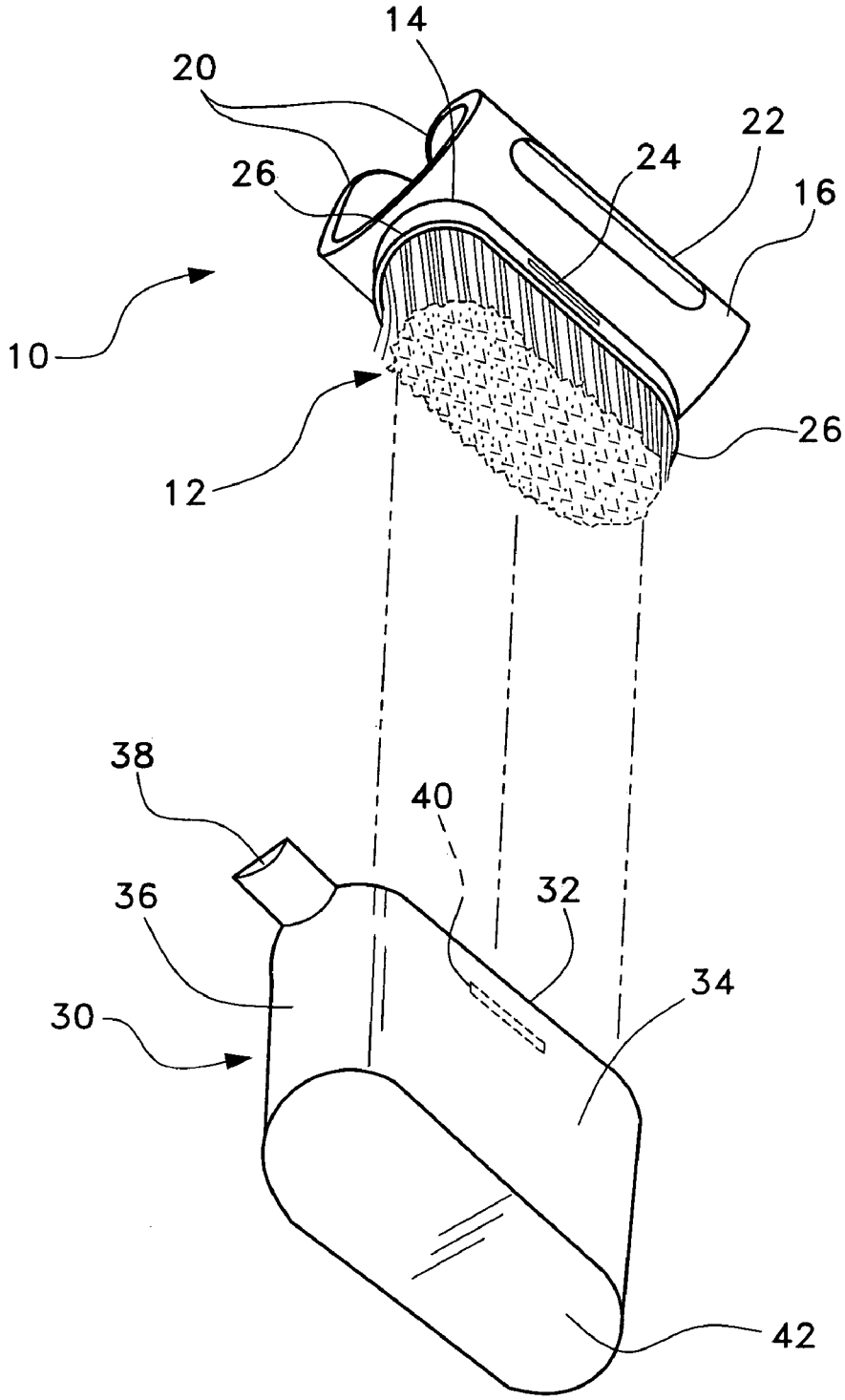
FIG. 2 is an exploded view of the toothbrush of FIG. 1 exploded away from its cover.
Figure 3:
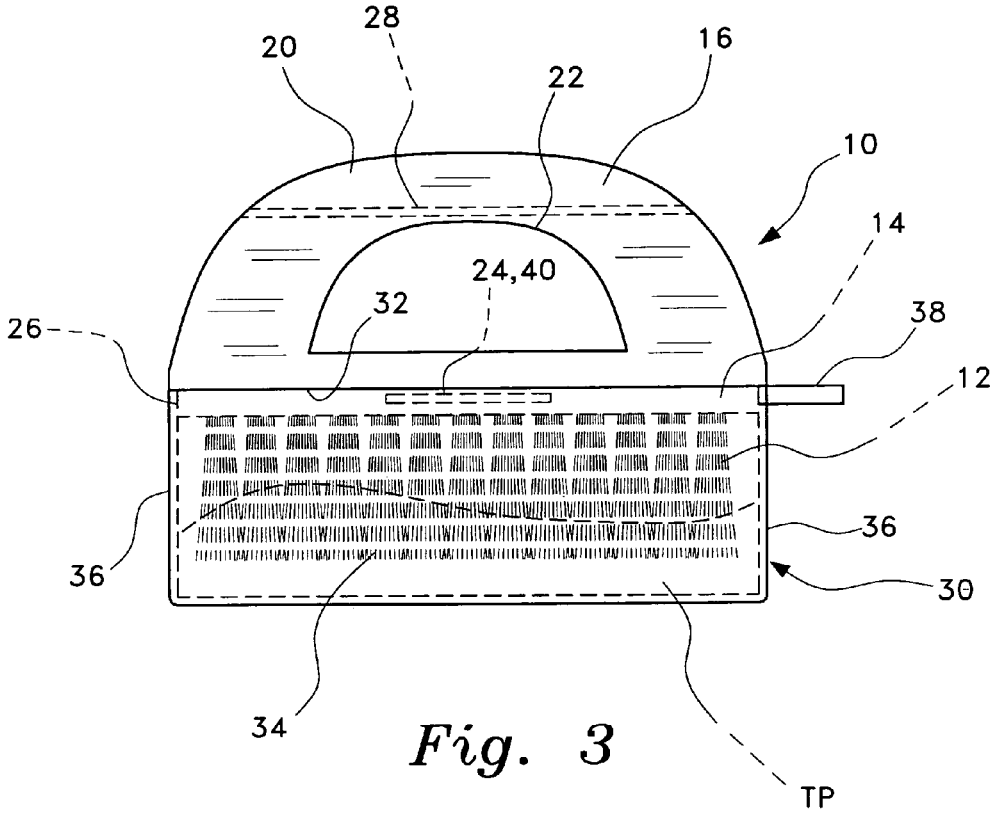
FIG. 3 is a side elevation view of the toothbrush and cover of FIG. 2 in kit form with toothpaste provided.

Referring to FIGS. 2 and 3, there is shown an exploded view of the finger-mounted toothbrush 10 and the brush cover 30 and a side elevation of the closed kit with toothbrush 10 secured in brush cover 30, respectively. Toothbrush 10 has bristle portion 12 mounted in a flat bristle receiver 14 connected with finger clip 16 as above. Finger clip 16 has curved elastic portions 20 forming a two-part open band ring-like structure which closes over a range of sizes of finger F once the elastic portions are spread apart by insertion of the finger therethrough. Finger clip curved elastic portions 20 have apertures 22 in the sides thereof for comfort during use. The apertures 22 also allow the skin of the user's finger to expand through the apertures, contributing to a firm fit.

Bristle receiver 14 has rounded ends 26 and generally parallel sides having snap ridge receiver grooves 24 therein. Brush cover 30 has an upper rim 32, sidewalls 34 having rounded ends 36, a separating tab 38 extending from one curved end at the lip 32 and opposed snap ridges 40 on the upper inner sides of sidewall 34. Brush cover 30 has a bottom wall 42.

As seen in FIG. 3, lip 32 of brush cover 30 conforms to and fits over bristle receiver 14 to form a seal therebetween. Snap ridges 40 engage snap ridge receiver grooves 24 to maintain bristle portion 12 within brush cover 30 until use. Toothpaste TP is contained in brush cover 30, covering the lower portion of bristles 12. Tab 38 is located at one end 36 of brush cover 30 at upper lip 32, tab 38 being useful to provide separating force to overcome the holding force of snap ridges 40 to remove cover 30 from toothbrush 10.

Figure 4:
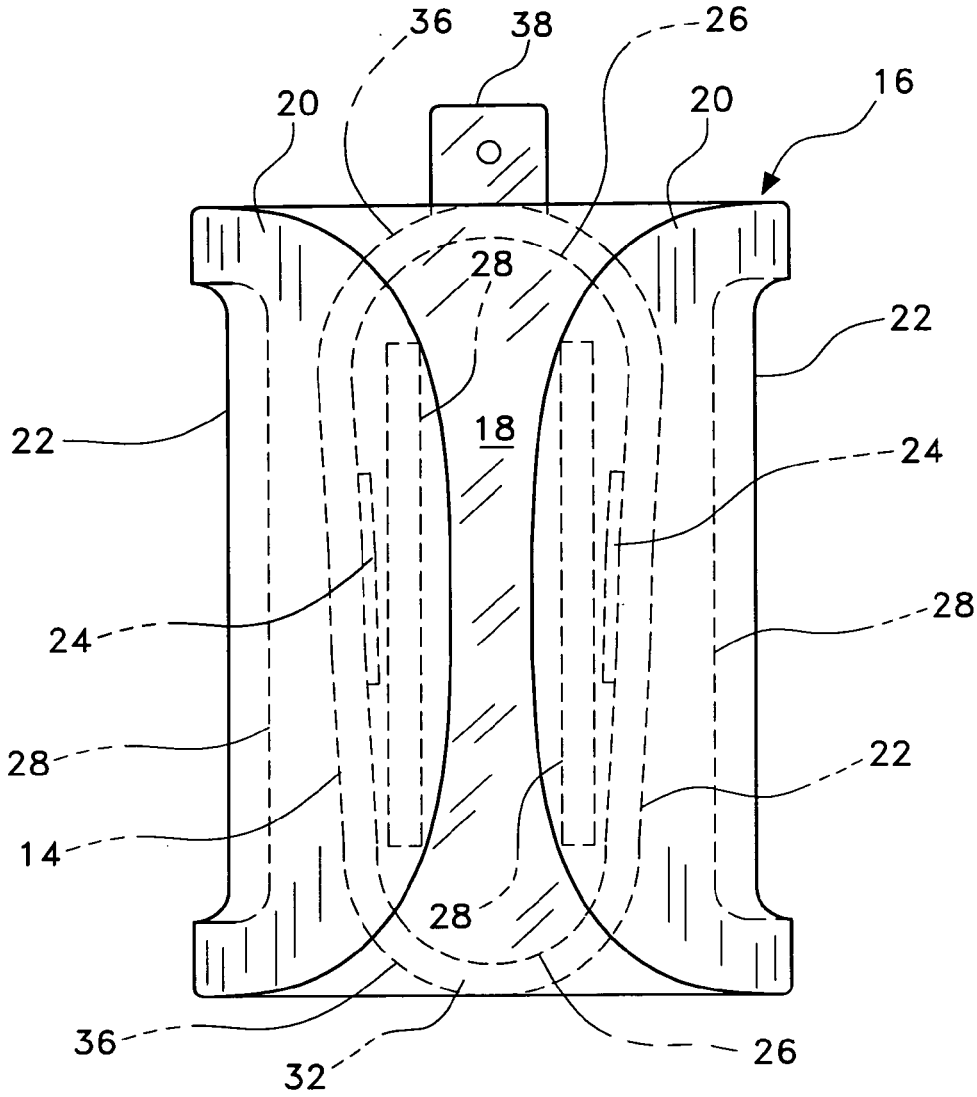
FIG. 4 is a top plan view of the toothbrush and cover of FIG. 2 in kit form.
Figure 5:
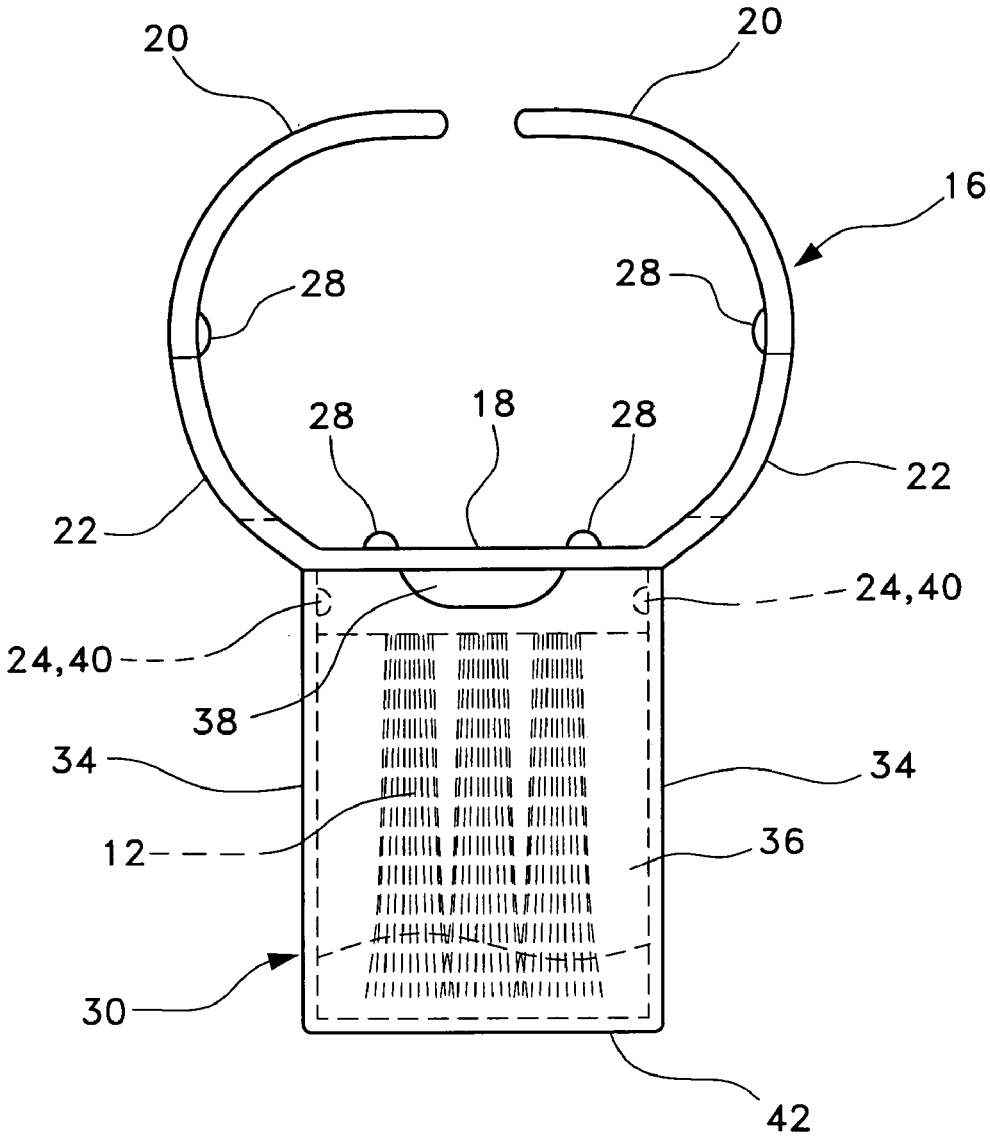
FIG. 5 is an end elevation view of the toothbrush and cover of FIG. 2 in kit form.

Referring to FIGS. 4 and 5 there is shown a plan view and an end elevation view of the closed toothbrush kit. Finger clip 16 has a lower flat portion 18 connected with bristle receiver 14 and sealing against upper lip 32 of brush cover 30. Tab 38 extends outward from one endwall 36 at upper lip 32 at one end.

As depicted in FIG. 4, the sidewalls of brush cover 30 may be wider at the proximate end 36 relative to tab 38 extends than at the distal end forming a tapered brush cover 30 fitting a like tapered bristle receiver 14. Finger clip 16 has two spaced lengthwise guide ridges 28 extending upward along the substantial length of finger clip flat portion 18. Each finger clip curved elastic portion 20 also has a lengthwise guide ride 28 extending along the substantial respective lengths thereof at points above and proximate to the upper edges of finger clip apertures 22. Guide ridges 28 help maintain the toothbrush 10 secure on and aligned with finger F (see FIG. 1) during brushing and to avoid rotation on the finger. The curved elastic portions 20 of the finger clip 16 maintain pressure on the inserted finger, keeping guide ridges firmly pressed against the finger, thus avoiding rotation around the finger.

In use, the user tears away any plastic wrapper and inserts his finger into the finger clip 16 of toothbrush 10. He then pulls on tab 38, snapping away the cover 30. After use the toothbrush and cover may be disposed of or the toothbrush and cover washed and the cover snapped onto the toothbrush to cover the bristles for later use.

The toothbrush and case of the present invention is preferably made from appropriate plastic materials. The kit may be stored and distributed in a clear, plastic, tear-away wrapper to avoid tampering.

It is to be understood that the present invention is not limited to the embodiment described above, but encompasses any and all embodiments within the scope of the following claims.

I claim:

1. A compact, disposable finger-mounted toothbrush, comprising:

an elongate, generally planar bristle receiver portion having an upper side and a lower side;

a bristle portion having bristle upper ends embedded in said bristle receiver portion at the lower side thereof and extending downward therefrom; and an elongate finger clip having forward and rear ends and attached to said bristle receiver portion comprising:

a flat portion attached along said bristle receiver portion upper side; and opposed curved elastic portions extending outward and upward from respective sides of said flat portion, said flat portion and said opposed curved elastic portions being so configured as to partially encircle and grip a user's finger;

each said curved elastic portion defining an elongate aperture proximate to and spaced above said flat portion to form partially open side portions for receiving corresponding side portions of the user's finger.

2. The finger-mounted toothbrush of claim 1, said finger clip having a plurality of guide ridges extending inward from the inner side of said finger clip and extending the substantial length thereof.

3. The finger-mounted toothbrush of claim 2, said finger clip guide ridges including two spaced, parallel guide ridges extending along said flat portion and two guide ridges extending along respective said curved portions above said apertures.

4. The finger-mounted toothbrush of claim 3, said bristle receiver having rounded ends and substantially parallel sides.

5. The finger-mount toothbrush of claim 3, said bristle receiver having a rounded front end, a rounded back end, and sides tapering inward from said rounded front end and said rounded back end, said bristle portion conforming with the shape of said bristle receiver.

6. The finger-mount toothbrush of claim 3, said curved portions forming a curved upper edge from front to rear thereof.

7. The finger-mount toothbrush of claim 1, wherein said bristle receiver and said finger clip is unitary.

8. A compact/disposable finger-mounted toothbrush kit, comprising:

a finger-mounted toothbrush comprising:

an elongate, generally planar bristle receiver portion having an upper side and a lower side and a surrounding sidewall having opposing sides;

a bristle portion having bristle upper ends embedded in said bristle receiver portion at the lower side thereof and extending downward therefrom; and an elongate finger clip having forward and rear ends and attached to said bristle receiver portion comprising:

a flat portion attached along said bristle receiver portion upper side; and opposed curved elastic portions extending outward and upward from respective sides of said flat portion, said flat portion and said opposed curved elastic portions being so configured as to partially encircle and grip a user's finger;

each said curved elastic portion defining an elongate aperture proximate to and spaced above said flat portion to form partially open side portions for receiving corresponding side portions of the user's finger; and a brush cover having a bottom wall, opposed sidewalls, rounded end walls and an open upper lip;

said brush cover upper lip conforming with said bristle receiver sidewall so to close thereover;

said brush cover bottom wall being sufficiently spaced from said upper lip such that said brush cover receives and closes over said bristle portion and said bristle receiver.

9. The toothbrush kit of claim 8, said surrounding sidewall of said bristle receiver defining at least one snap ridge receiver therealong; said brush cover having at least one inward extending snap ridge spaced below said upper rim and so positioned therealong to engage said snap ridge receiver upon closing said brush cover over said bristle receiver.

10. The toothbrush kit of claim 9, wherein said at least one snap ridge receiver comprises two snap ridge receivers located along opposing sides of said bristle receiver sidewall and said at least one inward extending snap ridges comprise two snap ridges located along opposing sidewalls of said brush cover and so positioned therealong to engage said snap ridge receivers upon closing said brush cover over said bristle receiver.

11. The toothbrush kit of claim 10, each said curved elastic portion of said finger clip defining an elongate aperture proximate to and spaced above said flat portion to form partially open side portions for receiving corresponding side portions of the user's finger.

12. The toothbrush kit of claim 11, said finger clip having a plurality of guide ridges extending inward from the inner side of said finger clip and extending the substantial length thereof.

13. The toothbrush kit of claim 12, said finger clip guide ridges including two spaced, parallel guide ridges extending along said flat portion and two guide ridges extending along respective said curved portions above said apertures.

14. The toothbrush kit of claim 13, said bristle receiver having a rounded front end, a rounded back end, and sides tapering inward from said rounded front end and said rounded back end, said bristle portion conforming with the shape of said bristle receiver.

15. The toothbrush kit of claim 14, said brush cover having a removal tab located at said rounded from end thereof at said upper rim.

16. The toothbrush kit of claim 15, said kit further comprising a supply of toothpaste housed in said brush cover.

17. The toothbrush kit of claim 10, said brush cover having a removal tab located at a rounded end thereof at said upper rim.

18. The toothbrush kit of claim 10, said kit further comprising a supply of toothpaste housed in said brush cover.

19. The toothbrush kit of claim 10, wherein said upper lip of said brush cover seals against said finger clip flat portion.

20. A compact, disposable finger-mounted toothbrush kit, comprising:

a finger-mounted toothbrush comprising:

an elongate, generally planar bristle receiver portion having an upper side and a lower side and a surrounding sidewall having opposing sides;

a bristle portion having bristle upper ends embedded in said bristle receiver portion at the lower side thereof and extending downward therefrom; and an elongate finger clip having forward and rear ends and attached to said bristle receiver portion comprising:

a flat portion attached along said bristle receiver portion upper side; and opposed curved elastic portions extending outward and upward from respective side of said flat portion, said flat portion and said opposed curved elastic portions being so configured as to partially encircle and grip a user's finger;

each said curved elastic portion defining an elongate aperture proximate to and spaced above said flat portion to form partially open side portions for receiving corresponding side portions of the user's finger;

said finger clip having two spaced, parallel guide ridges extending along said flat portion and two guide ridges extending along respective said curved portions above said apertures; and a brush cover having a bottom wall, opposed sidewalls, rounded end walls and an open upper lip;

said brush cover upper lip conforming with said bristle receiver sidewall so to close thereover;

said brush cover bottom wall being sufficiently spaced from said upper lip such that said brush cover receives and closes over said bristle portion and said bristle receiver;

said surrounding sidewall of said bristle receiver defining two snap ridge receivers located along opposing sides of said bristle receiver sidewall therealong;

said brush cover having two snap ridges located along opposing sidewalls of said brush cover and so positioned therealong to engage said snap ridge receivers of said bristle receiver upon closing said brush cover over said bristle receiver.

* * * * *